US007877196B2

(12) United States Patent
Lin et al.

(10) Patent No.: US 7,877,196 B2
(45) Date of Patent: Jan. 25, 2011

(54) ROAD CONGESTION DETECTION BY DISTRIBUTED VEHICLE-TO-VEHICLE COMMUNICATION SYSTEMS

(75) Inventors: Lan Lin, Cannes (FR); Tatsuaki Osafune, Sagamihara (JP)

(73) Assignee: Hitachi, Ltd., Tokyo (JP)

( * ) Notice: Subject to any disclaimer, the term of this patent is extended or adjusted under 35 U.S.C. 154(b) by 1000 days.

(21) Appl. No.: 11/711,632

(22) Filed: Feb. 28, 2007

(65) Prior Publication Data

US 2008/0059050 A1 Mar. 6, 2008

(30) Foreign Application Priority Data

Aug. 31, 2006 (EP) ..... 06018278

(51) Int. Cl.
*G08G 1/01* (2006.01)

(52) U.S. Cl. ..... 701/117; 701/119

(58) Field of Classification Search ..... None
See application file for complete search history.

(56) References Cited

U.S. PATENT DOCUMENTS

| | | | | |
|---|---|---|---|---|
| 5,428,544 | A * | 6/1995 | Shyu | 701/117 |
| 6,292,747 | B1 * | 9/2001 | Amro et al. | 701/213 |
| 6,711,493 | B1 | 3/2004 | Andrews et al. | |
| 6,765,495 | B1 * | 7/2004 | Dunning et al. | 340/903 |
| 7,382,274 | B1 * | 6/2008 | Kermani et al. | 340/901 |
| 2005/0156756 | A1 * | 7/2005 | Fujita et al. | 340/903 |
| 2006/0031003 | A1 * | 2/2006 | Sun et al. | 701/117 |

FOREIGN PATENT DOCUMENTS

| | | |
|---|---|---|
| EP | 1 489 578 | 12/2004 |
| JP | 2002-90165 | 3/2002 |
| WO | WO 2004/027729 A1 | 4/2004 |
| WO | WO 2005/004080 A1 | 1/2005 |

OTHER PUBLICATIONS

European search report dated Feb. 16, 2007.

* cited by examiner

*Primary Examiner*—Michael J. Zanelli
(74) *Attorney, Agent, or Firm*—McDermott Will & Emery LLP

(57) ABSTRACT

The present invention relates to a method and apparatus for determining traffic condition comprising the steps of determining periodically a position data of a host vehicle 1, wherein the position data includes a time stamp, position, velocity and driving direction of the host vehicle 1, receiving periodically position data of at least an other vehicle 2, 3, 4, wherein the position data includes a time stamp, position, velocity and driving direction of the other vehicle 2, 3, 4, storing the position data of the host vehicle 1 and the position data of at least the other vehicle 2, 3, 4, calculating a relative position data, wherein the relative position data includes relative velocity and relative driving direction between the host vehicle 1 and the other vehicle 2, 3, 4, and judging a traffic condition based on the position data of the host vehicle 1, the position data of the other vehicle 2, 3, 4 and the relative position data.

19 Claims, 8 Drawing Sheets

20

| Vehicle ID | Time stamp | Speed (Km/h) | Direction (degree) | Position |
|---|---|---|---|---|
| A | Hh:mm:ss | 30 | x | Xx.Xxxx N<br>Xx.Xxxx S<br>m |
| A | Hh:mm:ss | 25 | x | Xx.Xxxx N<br>Xx.Xxxx S<br>m |
| B | Hh:mm:ss | 20 | x | Xx.Xxxx N<br>Xx.Xxxx S<br>m |
| ... | ... | ... | ... | ... |

30

| Vehicle ID | Time stamp | Speed (Km/h) | Direction (degree) | Position | Relative distance (m) | Time to expire |
|---|---|---|---|---|---|---|
| A | Hh:mm:ss | 30 | x | Xx.Xxxx N Xx.Xxxx S m | 20 | Hh:mm:ss |
| A | Hh:mm:ss | 25 | x | Xx.Xxxx N Xx.Xxxx S m | 25 | Hh:mm:ss |
| C | Hh:mm:ss | 20 | x | Xx.Xxxx N Xx.Xxxx S m | 40 | Hh:mm:ss |
| ... | ... | ... | ... | ... | ... | ... |

Fig.3

60

| Request ID | Vehicle ID | Message type (0 or 1) | Time stamp | Position | Jam voting (0 or 1) | Time to expire (count) | Direction (degree) |
|---|---|---|---|---|---|---|---|
| x | A | 0 | Hh:mm:ss | Xx.Xxxx N Xx.Xxxx S m | 1 | Hh:mm:ss | x |

Fig. 6

ROAD CONGESTION DETECTION BY DISTRIBUTED VEHICLE-TO-VEHICLE COMMUNICATION SYSTEMS

BACKGROUND OF THE INVENTION

1. Field of the Invention

The invention relates to traffic condition detection by vehicle-to-vehicle communication systems. More particularly, the present invention relates to a method and apparatus for detecting and diffusing traffic condition information by distributed vehicle-to-vehicle communication systems.

2. Description of the Related Art

It is well known in traffic management that unwanted traffic conditions, such as traffic jams may cause road safety problems as well as economic loss. The road safety problems are due to a vehicle approaching an unexpected end of a traffic jam, as the vehicles in front of the vehicle are driving with a lower speed or have came to a complete halt at all. Besides that, traffic jams may also cause an economic loss, as the overall efficiency of traffic is reduced so that goods and services may not arrive in time and such a delay may impose further costs.

In order to overcome the above, two main solutions exist, namely to construct an improved road infrastructure or to enhance the travel efficiency on the existing road infrastructure. Usually, the first solution is avoided, as it imposes very high costs and has a large impact on the environment, which effects and costs in the future can not be estimated by now. Accordingly, the second solution attracts nowadays more and more attention.

As traffic management is one of the main methods for this solution, traffic condition information is becoming more and more important for an efficient traffic management. With the knowledge about the traffic condition, travelers in their vehicles can adapt their route to avoid any unwanted traffic condition, such as a jam or stop-and-go traffic. Additionally, traffic management operators can take countermeasures so that any unwanted traffic condition can be resolved (e.g. controlling of traffic lights, imposing speed limits, detours, etc.) and inform the travelers accordingly.

At present, traffic conditions are detected and diffused by centralized traffic management control centers using traffic message channel (TMC). Accordingly, sensors have to be equipped at the road infrastructure and/or on the vehicles that collect data about traffic flow and transmitters send such data to the travel management centre via a pre-installed communication infrastructure. In the traffic management centre the data is analyzed using special algorithms to attain the traffic condition information. This information is then sent to the travelers en route and the traffic management operators again via a pre-installed infrastructure. As this method requires a dedicated road side infrastructure, due to costs it is only available on highways but not on urban or rural roads. Accordingly, traffic condition information is not available to travelers once they left the highway. Even on the highway, it can happen that drivers of a vehicle approaching a traffic condition do not know about said condition as said traffic condition has occurred recently, and not been processed yet at the travel management centre (cf. safety problem).

In WO 2005/5004080 a system for automatic detection and report of a sudden traffic jam is described, wherein roadside communication units are used that are installed along the highway to collect the probe data of the passing vehicles. Each vehicle is equipped with a communication device that has been pre-registered by a travel management operator. The collected information will be then sent to the travel management control centre for data analysis and traffic jam detection. The described system uses a road side unit every two kilometers and a travel management control centre that collects and analyses the data of vehicles. Accordingly, the costs of such an implementation are very high.

WO 2004/027729 relates to a method and system for detecting and estimating road traffic from location data of mobile terminals in a radio communication system. Such a method and system imposes said deficiencies that also a travel management control centre is needed and that the position of the mobile terminals has to be matched with a digital map, imposing additional costs. Further, only the movement of the mobile terminal itself is detected but no information about the surrounding terminals is exchanged.

JP 2002/090165 describes a traffic jam detection device using an onboard sensor in a vehicle to detect the present location at an instant and calculate two different average speeds from the present location based on two different time intervals. According to the two different average speeds, the device determines if the vehicle is in traffic jam or not. However, as the device only takes in consideration the behavior of the vehicle it is mounted on, the overall traffic condition can not be determined.

OBJECT OF THE INVENTION

Accordingly, it is an object of the present invention to provide a method and apparatus for reliably detecting the overall traffic condition.

It is a further object of the present invention to provide a method and apparatus to reliably detect the head and the end positions of a traffic condition by using vehicle-to-vehicle communication.

These objects are achieved by the method and apparatus according to the present invention as defined by the independent claims. The dependent claims relate to preferred embodiments of the invention.

The present invention proposes a wireless communication system, such as a wireless vehicle-to-vehicle communication system, by which a traffic condition can be determined.

Exemplary traffic conditions that can be determined are free flow of traffic, traffic jam, complete halt and/or restricted flow of traffic.

Accordingly, the vehicles equipped with vehicle-to-vehicle communication systems can exchange messages between each other in a certain communication range. Such a communication range can be up to 1 kilometer around the respective vehicle. For safety applications (pre-crash) such a communication range has to be not less than 400 meters.

The detection of a traffic condition can be described as a two-step procedure. In a first step, vehicles exchange periodically position data among each other in the communication range. By receiving the position data from other vehicles, each vehicle, so called host vehicle, keeps a table of position data and can derive historical movement information of said other vehicles. In the table an expiry time can be set to possibly discard old data, or the signal itself contains a time-to-expire component. Based on the data stored in the table, the host vehicle can estimate the traffic condition it is subjected. For example, if the host vehicle is driving at a low speed and the vehicles around the host vehicle are also driving at a low speed, it can be judged that the host vehicle is either in a jam or in a restricted flow traffic condition.

The second step is detecting the position of the traffic condition as well as the beginning and the end positions of the traffic condition. To achieve such detection, a voting process inside the vehicle-to-vehicle network can be established.

Based on the estimation of the first step, each vehicle in the network has its own estimation result (e.g. jam/no jam) derived from an in-car process. One of the vehicles that estimate that it is in an undesired traffic condition, e.g. jam, broadcasts a voting message to the other vehicles in the communication range and requests the other vehicles to answer with their own estimation results. By receiving and evaluating the reply messages, the host vehicle can more specifically determine its own traffic condition situation. For example, if most of the reply messages also include the same traffic condition (e.g. jam) as the host vehicle request message, it is very likely that all vehicles in the communication range of the host vehicle are subject to the same traffic condition, namely jam.

Further, to detect the beginning or the end position of the traffic condition, the host vehicle divides the reply messages into two groups based on the position data of the reply vehicles: replies from vehicles in an upstream direction of the host vehicle and replies from vehicles in a downstream direction of the host vehicle. In the following description, the term downstream is defined as ahead of the host vehicle in a general forward driving direction, and the term upstream is defined as behind the host vehicle in a general forward driving direction. Accordingly, if a large percentage, for example more than 80% of reply in-jam messages is received from an downstream direction of the host vehicle, it can be assumed that the host vehicle is at or near the end of the traffic condition and vice versa, namely if a large percentage of the in-jam reply messages is received from upstream of the host vehicle, it can be assumed that the host vehicle is at or near the beginning of the traffic condition.

Summarizing, the proposed detection method for detecting a traffic condition is capable, by using vehicle-to-vehicle communication, to detect a traffic condition without utilizing a traffic management control centre, an embedded digital map, or roadside infrastructure. Further, the traffic condition information is obtained and transmitted onside in real time. Additionally, the vehicles located at the end of a traffic condition can generate and broadcast an additional warning message. It is also possible that any information about the traffic condition can be sent via any available communication infrastructure (road side, GSM, WiFi) to traffic management control centers or the like, which then diffuses said information via TMC also to vehicles not equipped with vehicle-to-vehicle capabilities.

A method for determining traffic condition may comprise at least one of the following steps: determining and broadcasting periodically a position data of a host vehicle, wherein the position data includes a time stamp, position, velocity and driving direction of the host vehicle, receiving periodically position data of at least an other vehicle, wherein the position data includes a time stamp, position, velocity and driving direction of the other vehicle, storing the position data of the host vehicle and the position data of at least the other vehicle, calculating a relative position data, wherein the relative position data includes relative velocity and relative driving direction between the host vehicle and the other vehicle, and judging a traffic condition based on the position data of the host vehicle, the position data of the other vehicle and the relative position data.

In a preferred embodiment, the position data of the other vehicle may be discarded when the angle of the relative direction between the host vehicle and the other vehicle is larger than a predetermined angle and/or when the time interval between the time stamp of received position data from the other vehicle and the actual time of host vehicle is larger than a predetermined period.

Preferably, the method can determine a traffic jam estimation value based on the position data of the host vehicle and/or a relative traffic jam estimation value based on the relative position data between the host vehicle and the other vehicle.

Further, it may be possible to weight the traffic jam estimation value and the relative traffic jam estimation value based on the relative position data.

In a preferred embodiment, a voting jam value can be determined based on the traffic jam estimation value and the relative traffic jam estimation value. Additionally, based on the voting jam value, a voting request message can be broadcasted by at least the host vehicle.

Based on a received voting request message, the other vehicles can broadcast a voting reply message as a response thereto.

In a preferred embodiment, based on the voting request message and received voting reply message, the host vehicle can determine at least a traffic condition and/or the position of the host vehicle in respect to the traffic condition. Based on the position of the host vehicle with respect to the traffic condition, at least a further traffic condition message can be broadcasted by the host vehicle.

An apparatus for determining traffic condition may comprise at least one of the following: a position determining means for periodically determining a position data of a host vehicle, wherein the position data includes a time stamp, position, velocity and driving direction of the host vehicle, a broadcasting means for periodically broadcasting position data of the host vehicle, a receiving means for periodically receiving position data of at least an other vehicle, wherein the position data includes a time stamp, position, velocity and driving direction of the other vehicle, a storing means for storing the position data of the host vehicle and the position data of at least the other vehicle.

Further, the apparatus may comprise at least one of a relative position calculating means calculating a relative position data, wherein the relative position data includes relative velocity and relative driving direction between the host vehicle and the other vehicle, and a traffic condition judging means for judging the traffic condition based on the position data of the host vehicle, the position data of the other vehicle and the relative position data, and a timer setup means to setup a timer to generate the reply messages and/or a timer to collect the reply messages. These timers can have the same or different timevalues. Further, the timers can be setup at the host vehicle side or the other vehicle side.

Further, in a preferred embodiment, the apparatus according to the present invention can be configured to carry out any of the method steps according to the present invention as described herein.

The position determining means can comprise a global positioning system (GPS, Galileo system, GSM triangulation), a gyroscope, a compass, a gyrocompass, a pulse counter, a tachometer and/or any suitable means for determining a position.

The receiving means, the sending means and the broadcasting means, summarized as communication means, can be IEEE 802.11 family (802.11a-802.11p, e.g. WLAN), IEEE 802.15 (e.g. ZigBee, Bluetooth), DSRC, and the respective protocol thereof. The protocols used may be IPv4 or IPv6 or any other specific vehicle-to-vehicle protocols. The frequency used by the communication means can lie between 2.4 and 5.9 GHz.

The time interval for periodically determining the position data can be set in accordance with the requirement of the application. Based on the application requirements (safety application or traffic efficiency application) the position data can be derived for different time intervals. Accordingly, the time can be less than 5 sec, less than 3 sec or equal or less than 1 sec, as well as any intermediate value.

The relative direction between the host vehicle and the other vehicle indicates whether the vehicles travel in the same or different direction. It is considered that any pair of vehicles travels into the same direction when the angle between the driving directions of the pair of vehicles is less than a predetermined threshold, for example, less than 90°. If the angle is larger than the predetermined threshold, the position data might be discarded. This process can be used to determine the traffic direction without help of an embedded digital maps.

The period for discarding the position data, when the time interval between the time stamp of the position data received from other vehicle and the actual time is larger than that period, can be set to any value between 1 and 60 sec, 10 and 45 sec or between 20 and 30 sec. It is also possible that the position data or a message containing the position data include a time-to-life variable representing the period for discarding. This time interval can be used to discard the expired (out-of-date data) of the vehicles.

The position data can also be discarded, if the distance between the pair of vehicles exceeds a predetermined threshold. The threshold can be 1000 m, 800 m, 600 m, 400 m, 200 m or 100 m, as well as any intermediate value. Setting such distance can be used to cancel the data from vehicles too far away from the host vehicle, where the traffic condition could be considerately different.

A traffic jam estimation value can be determined by calculating a first average speed of the host vehicle over a first time period. The respective time period can be set to any value between 1 and 60 sec, 10 and 45 sec or between 20 and 30 sec. If the first average speed is lower than a predetermined threshold, the vehicle is estimated in a jam. Additionally, a relative traffic jam estimation value can be determined by calculating a second average speed, representing the average relative speed between host vehicle and any other vehicles. The respective time period can also be set to any value between 1 and 60 sec, 10 and 45 sec or between 20 and 30 sec. Accordingly, when the second average speed is below a predetermined threshold, it can be considered that the host vehicle and the surrounding vehicles are traveling at a similar speed and/or subject to the same traffic condition. The threshold for the first and/or second average speed can be less than 20 km/h, 10 km/h, or 5 km/h.

Additionally, the distance between the host vehicle and any other vehicle can be taken into account while calculating the significance of said second average speed. Accordingly, the larger the distance, the less important is the relative traffic jam estimation value. It can be assumed that the relevance is indirect proportional (1/x), $1/x^2$ or anything suitable to the distance between host vehicle and any other vehicle.

The traffic jam estimation value can also be considered as a flag value comparing the velocity of the host vehicle with a predetermined threshold. Accordingly, the relative traffic jam estimation value cans also be considered a flag value comparing the relative velocity between host vehicle and any other vehicle with a predetermined threshold.

After the calculation of the traffic jam estimation value and the relative traffic jam estimation value, different importance factors can be assigned to these two parameters. The importance factors can be used to balance the importance of the traffic jam estimation value and relative traffic jam estimation value. These importance factors can be calibrated prior the use or adapted during a learning phase.

Based on the traffic jam estimation value and the relative traffic jam estimation value a voting jam value can be determined. This voting jam value can be used for determining if the host vehicle considers itself in the traffic jam. This voting jam value can be a flag value indicating if the host vehicle is in jam or not in jam.

To announce its own jam situation to other vehicles, the host vehicle can broadcast a respective message. The message can comprise at least one of a request ID, vehicle ID, a message type, a time stamp, a position of the vehicle, a voting jam value, a time to expire, and a driving direction.

After the host vehicle has broadcasted a voting request message, it waits for a predetermined time to collect the voting reply message as a response to the voting request message. Based on the voting request message and the received voting reply message, the host vehicle can determine if the replying vehicle is either upstream or downstream of the vehicle, driving in the same direction, and if it is subject to the same traffic condition of the host vehicle.

Depending on the relation between the answers of vehicles downstream and vehicle upstream within the same traffic condition, the host vehicle can determine its position within the traffic condition. For example, if the number of vehicles upstream is much larger than the vehicles downstream within the same traffic condition, the host vehicle is in the front end of the traffic condition. Also the contrary holds true, if the number of vehicles upstream is much smaller than the number of vehicles downstream within the same traffic condition, the host vehicle is at the rear end of the traffic condition. In the case the host vehicle is at the rear end of the traffic condition, the host vehicle can broadcast an additional warning message directed to the following vehicles.

BRIEF DESCRIPTION OF THE DRAWINGS

In the following, preferred embodiments and further details of the present invention will be described in more detail with reference to the accompanying drawings.

FIG. 3 shows an updated historical data table.

FIG. 6 shows a jam voting message set, and

DETAILED DESCRIPTION

Figures 1, 2:
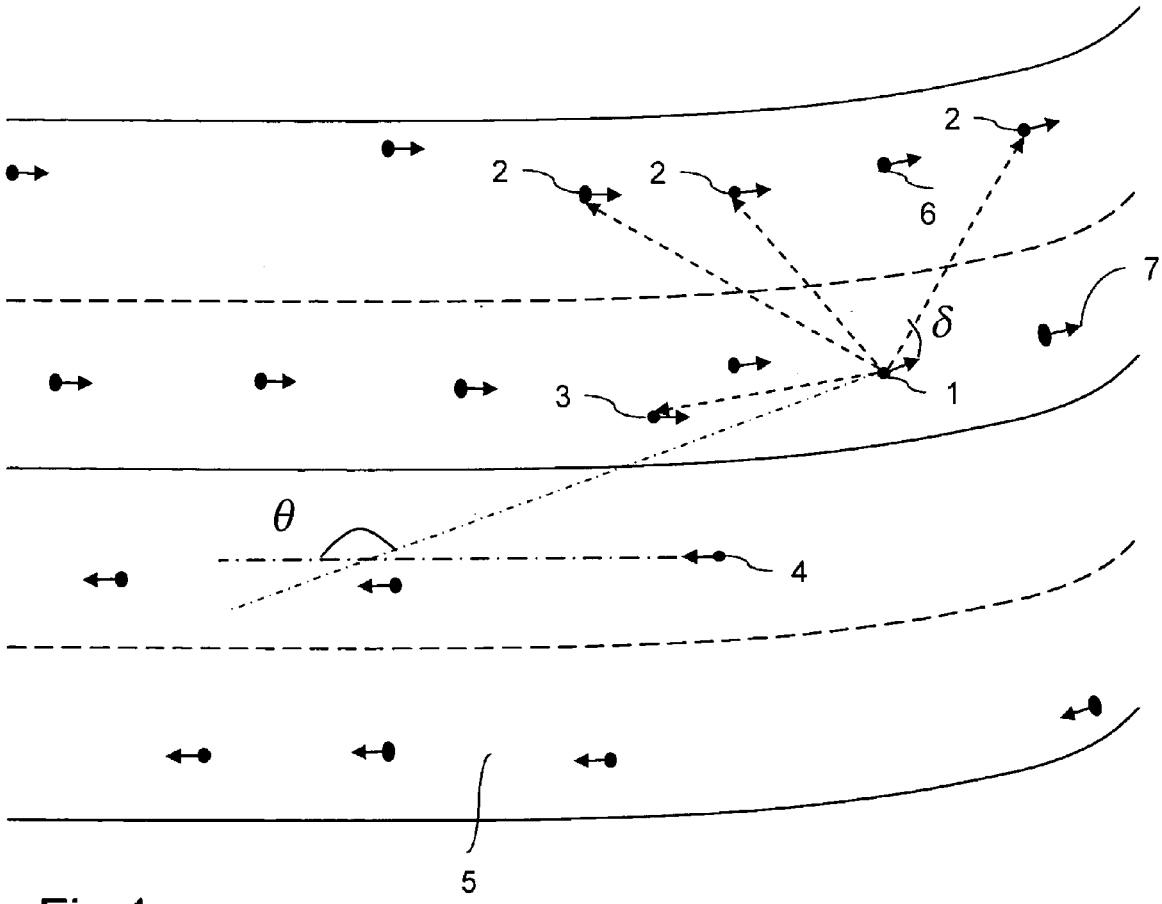
FIG. 1 shows a scheme of the scenario of traffic condition detection.
FIG. 2 shows the table storing the position data of the other vehicles.

FIG. 1 shows an overall scenario of traffic condition detection. The black nodes represent vehicles driving on a road 5, host vehicle 1 and other vehicles 2, 3, 4 are equipped with communication means and position detection means. Preferably, they are all inside the communication range of each other. The remaining vehicles 6 are either not equipped with communication means and position detection means or not within the communication range. Accordingly, these vehicles do neither participate to the communication network nor in the traffic condition detection process. The arrow 7 pointing away from each vehicle represents its velocity vector. The length of the arrow represents the travelling speed over ground of the vehicle, and the direction of the arrow represents the driving direction of the vehicle with regard to true north. The vectors are denoted as $\vec{V}_i$ (i representing each vehicle). At a certain time $t_i$ the position of vehicle i is denoted as $P_i^t=[X_i,Y_i,Z_i]$, $X_i$ representing the longitude, $Y_i$ representing the latitude and $Z_i$ representing the altitude of the vehicle.

The relative distance between any pair of vehicles i and j can be denoted as $D_{ij}$. $D_{ij}$ can be calculated using the following formula $$D_{ij}=\sqrt{(X_i-X_j)^2+(Y_i-Y_j)^2+(Z_i-Z_j)^2} \quad (1)$$

Accordingly, the distance between host vehicle 1 and the other vehicle 2 can be calculated as $$D_{12}=\sqrt{(X_1-X_2)^2+(Y_1-Y_2)^2+(Z_1-Z_2)^2} \quad (2)$$

The angle $\theta_{ij}$ between the driving directions of any pair of vehicles i and j can be calculated as $$\arccos(\theta_{ij}) = \frac{\vec{V}_i \times \vec{V}_j}{|\vec{V}_i| * |\vec{V}_j|}, \quad (3)$$

wherein $\vec{V}_i$ represents the velocity vector of vehicle i, $\vec{V}_j$ represents the velocity vector of vehicle j, $|\vec{V}_i|$ represents the amount of represents the amount of $\vec{V}_j$, and $\vec{V}_i \times \vec{V}_j$ represents the vector product between $\vec{V}_i$ and $\vec{V}_j$ This angle $\theta_{ij}$ is calculated in order to identify the vehicles driving in opposite direction. Data received from vehicles driving in the opposite direction might not be considered for the traffic condition detection. If this angle $\theta_{ij}$ is lower than a predetermined threshold $Th(\theta_{ij})$ ($Th(\theta_{ij}) \geqq \theta_{ij}$), it can be assumed that the pair of vehicles is driving generally in the same direction. In the case the angle $\theta_{ij}$ is larger than a predetermined threshold $Th(\theta_{ij})$ ($Th(\theta_{ij}) < \theta_{ij}$), the vehicle is considered driving generally in the opposite direction. The position data from these vehicles driving in the opposite direction can be discarded from the traffic condition detection. For example, in FIG. 1, vehicle 4 is driving in the opposite direction of the host vehicle 1 and the other vehicles 2. Accordingly, any data sent from vehicle 4 might be discarded.

An angle δ denotes the angle between the velocity vector of vehicle i and the position vector from vehicle i to any other vehicle j in the communication network. The angle δ is calculated in order to identify if the vehicle j is located in an upstream direction or a downstream direction of vehicle i. The vector pointing from the vehicle i to the vehicle j is denoted as $\vec{ij}$. The amount of this vector $\vec{ij}$ is equal to the relative distance between any pair of two vehicles $D_{ij}$.

$$\vec{ij}=\vec{j}-\vec{i}=(Xj-Xi)\vec{X}+(Yj-Yi)\vec{Y}+(Zj-Zi)\vec{Z}. \quad (4)$$

The angle δ between the vector $\vec{ij}$ and the velocity vector $\vec{V}_i$ of vehicle i is calculated $$\arccos(\delta_{ij}^t) = \frac{\vec{V}_i \times \vec{ij}}{|\vec{V}_i| * |\vec{ij}|}, \quad (5)$$

wherein, $\vec{ij}$ represents the position vector between vehicle i and vehicle j, $\vec{V}_i$ represents the velocity vector of vehicle i, $|\vec{V}_i|$ represents the amount of $\vec{V}_i$, $|\vec{ij}|$ represents the amount of $\vec{ij}$, and $\vec{V}_i \times \vec{ij}$ represents the vector product between $\vec{V}_i$ and $\vec{ij}$.

In the case the angle δ is less than a first predetermined threshold $Th(\delta_1)$ ($Th(\delta_1) \geqq \delta$), the vehicle j is considered at a downstream position traffic of the vehicle i. Contrary thereto, in the case the angle δ is larger than a second predetermined threshold $Th(\delta_2)$ ($Th(\delta_2) \leqq \delta$), the vehicle j is considered at an upstream position traffic of the vehicle i. Preferably, for detection of a vehicle at a downstream position, the first threshold $Th(\delta_1)$ can be set to equal or less than 90°, and for detection of a vehicle at an upstream position, the second threshold $Th(\delta_2)$ can be set to between 90° and 180°.

FIG. 2 shows an exemplary data table 20 for received position data from the other vehicles 2, 3, 4 within the communication range of the host vehicle 1. For each other vehicle, the data set includes a vehicle identifier (vehicle ID), a time stamp, a velocity vector (speed and driving direction) and the position. The vehicle data table is kept by the host vehicle 1. The vehicle ID is a temporary identifier of the other vehicle 2, 3 participating in the communication network assigned to the other vehicles 2, 3, 4 by a specific network configuration process of vehicle-to-vehicle communication system. The time stamp is the time when the data is sent out from the other vehicle 2, 3. In the case GPS is used, the time stamp can be changed every 1 sec. Time stamp is noted as $t_i$. The speed is the actual speed of the other vehicle 2, 3 over ground at time $t_i$, the unit is km/h. The direction is the actual driving direction of the vehicle with regard to true north. Speed and driving direction represent the velocity vector of the vehicle I, noted as $\vec{V}_i$. Position relates to the global geographic position measured by the position determining means, it is described with latitude $X_i$, longitude $Y_i$ and altitude $Z_i$. The position can be expresses as a position vector $P_i^t=[X_i,Y_i,Z_i]$.

Additionally, it is possible to have multiple data sets for one vehicle, wherein the data sets vary with respect to the timestamp.

FIG. 3 shows an extended data table 30, adapted for the use of traffic condition detection. The extended data table is based on the data table described with respect to FIG. 2. The same parameters such as vehicle ID, time stamp, speed, direction and position are denoted with the same identifiers. Additionally, the extended data table includes at least two further columns, time-to-expire, and relative distance. Time-to-expire represents the time limit when the data from the other vehicle 2, 3, 4 should be considered as too old and therefore should be discarded from the (extended) data table. The time-to-expire is measured in milliseconds and can be fixed or variable. The relative distance $D_{ij}$ is the distance between any pair of host vehicle 1 and other vehicle 2, 3, 4. The relative distance $D_{ij}$ is calculated according formula (1). Also in this table, the data of vehicles who are considered as in the opposite traffic direction of the host vehicle are also discarded.

Figure 4:
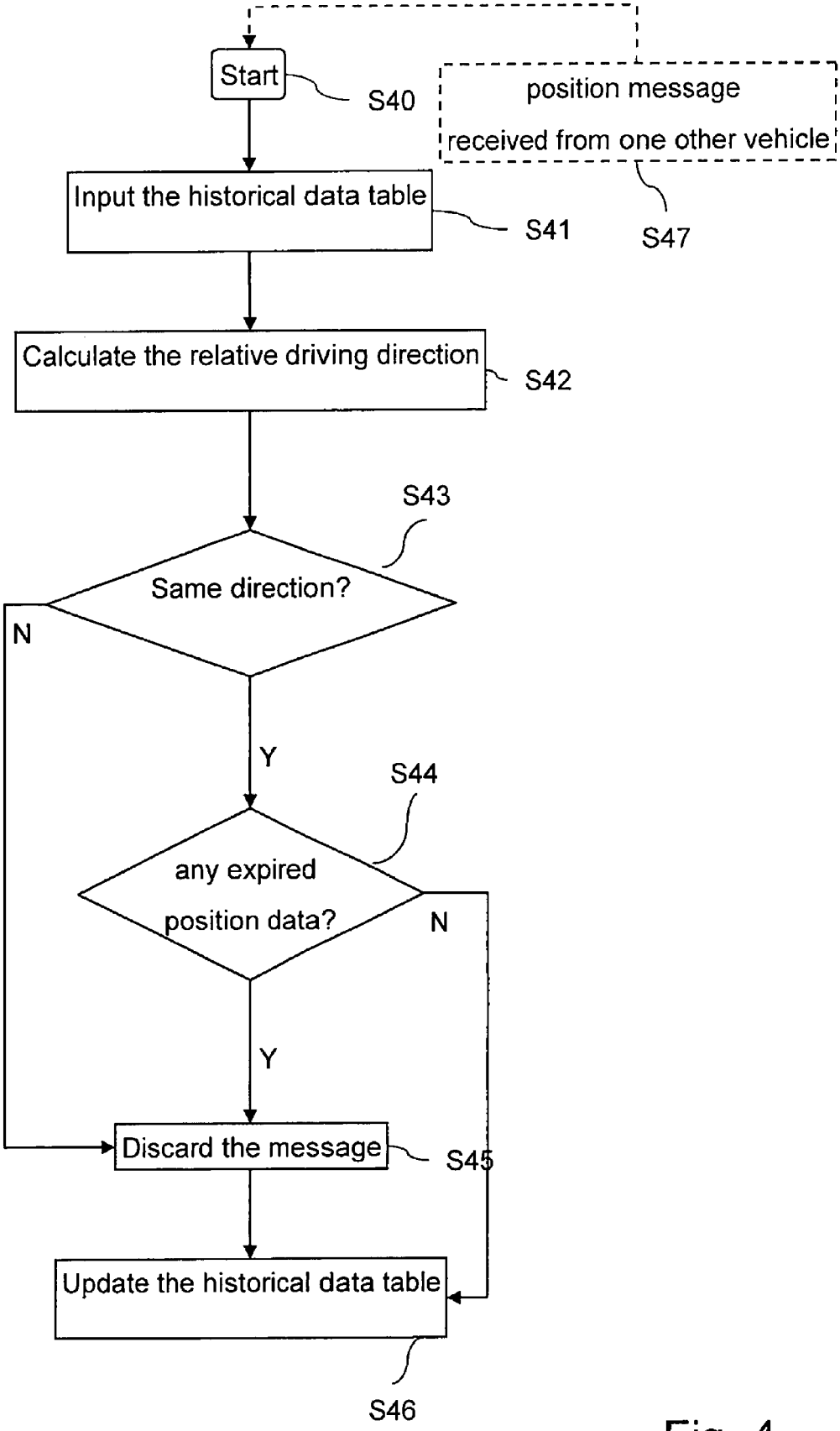
FIG. 4 shows a flowchart for updating the table.

FIG. 4 describes the flow chart for updating of the data tables 20, 30. When the host vehicle 1 receives a new position data from another vehicle 2, 3, 4, the update process is started. At step S41, the data is into the data table 20. Then at step S42, from the position data, the driving direction of the other vehicle 2, 3, 4 compared to the host vehicle 1 is calculated. At step S43 it is judged if the other vehicle 2, 3, 4 and the host vehicle 1, are travelling in the same direction. If the vehicles are travelling in the opposite directions (such as vehicle 4), the data set is discarded at Step S45. In the case the vehicles are travelling in the same direction, it is decided at step S44 if there is any data in the table 20 that has expired, as it is too old. If the data is too old, the data set is discarded at Step S45. In the case the vehicles are travelling in the same direction and the data has not been expired, the extended data table 30 is updated and modified for traffic condition detection.

Figure 5:
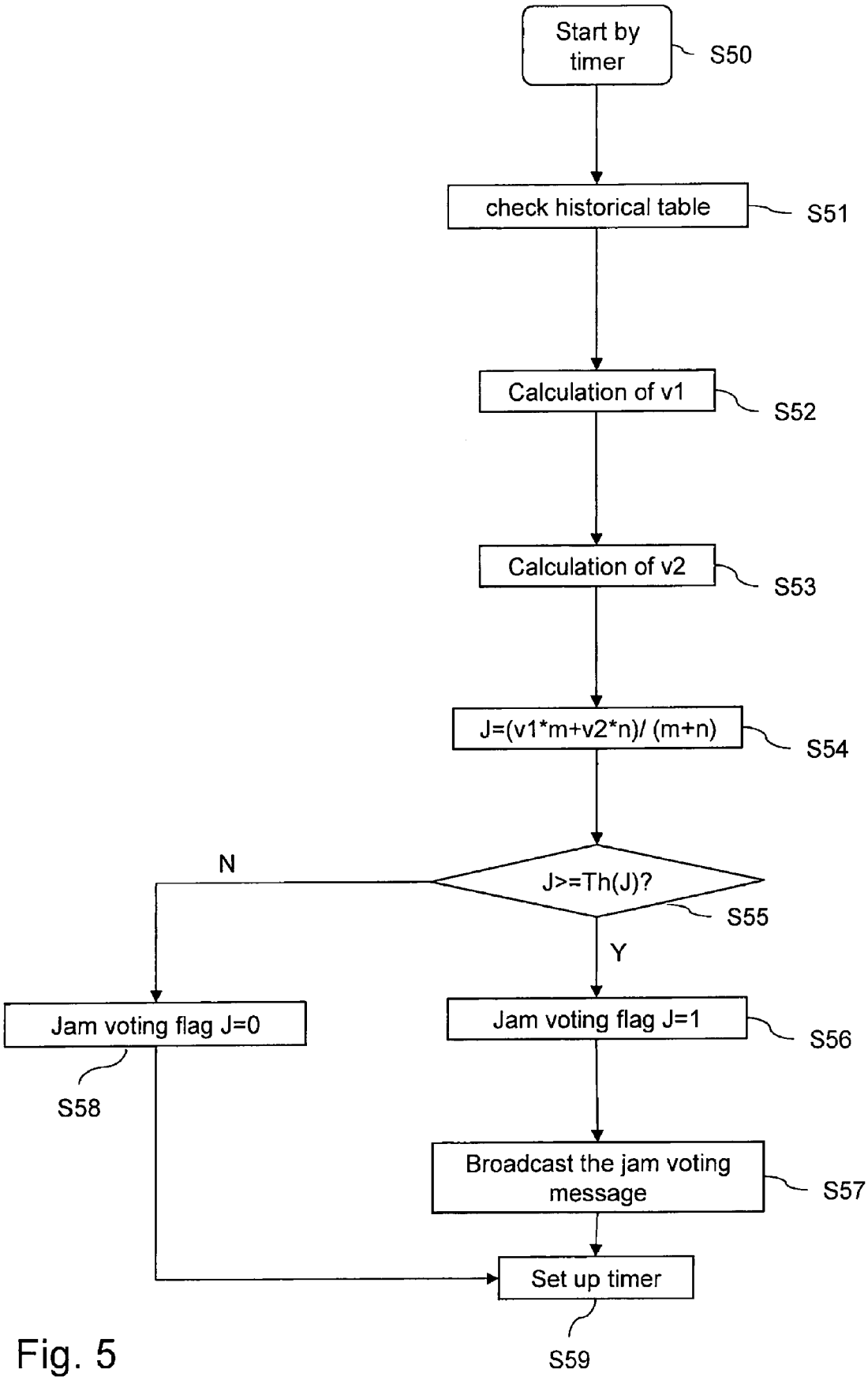
FIG. 5 shows a flowchart of an in-vehicle calculation and request process at the host vehicle.

FIG. 5 describes a flow chart for periodical in-vehicle process for calculation of a jam estimation value of the host vehicle 1. A timer is set up to define the periodical time interval. The calculation can begin from Start at step S50 when the timer is up. First, in step S51, the extended data table is checked according the process described with respect to FIG. 4. After that at step S52 the parameter v1 and at step S53 the parameter v2 is calculated.

v1 is the flag parameter for the traffic jam estimation based on the average speed $E(V_i^t)$ during a time window tw of host vehicle 1 itself.

$$E(V_i^t) = \frac{\int_{t-tw}^{t} V_i^t}{t-(t-tw)} = \frac{\sum_{t-tw}^{t} V_i^t}{tw} \tag{6}$$

If the vehicle is in the traffic jam, it is assumed that the vehicle drives at a lower speed A threshold Th(v1) is used to determine the value of v1. If the average speed $E(V_i^t)$ is lower than Th(v1), the vehicle is considered as in the jam and v1 set to 1. If the average speed $E(V_i^t)$ is larger than Th(v1), v1 is set to 0.

$$E(V_i^t) \leqq Th(v1) \Rightarrow v1=1$$

$$E(V_i^t) > Th(v1) \Rightarrow v1=0$$

v2 is the flag parameter for the relative traffic jam estimation value based on the relative speed $\Delta V_{ij}$ between each other vehicles 2, 3, 4 in the extended data table 30 and the host vehicle 1 itself.

$$\Delta V_{ij}^t = |E(V_i^t) - E(V_j^t)| \tag{7}$$

As many relative speeds can be calculated with the extended data table 30. Accordingly, it is assumed that vehicles farther away from the host vehicle 1 are less important to the traffic condition of the host vehicle 1. We take the inverse value of relative distance $D_{ij}$, namely $1/D_{ij}$ into account. As a result thereof, the larger the $D_{ij}$ is, the less important it is for the relative speed between the host vehicle 1 and the respective other vehicles 2, 3, 4. An average relative speed of the host vehicle $\Delta V_i$ considering the relative distance can be calculated as:

$$\Delta V_i^t = \frac{\sum_{j=1}^{n} \frac{\Delta V_{ij}^t}{D_{ij}^t}}{\sum_{j=1}^{n} \frac{1}{D_{ij}^t}} \tag{8}$$

A threshold Th(v2) is used to determine the value of v2. If the relative speed $\Delta V_i^t$ is lower than Th(v2), the vehicle is considered as in the jam and v2 set to 1. If the relative speed $\Delta V_i^t$ is larger than Th(v2), v2 is set to 0.

$$\Delta V_i^t \leqq Th(v2) \Rightarrow v2=1$$

$$\Delta V_i^t > Th(v2) \Rightarrow v2=0$$

After calculation of v1 and v2, different importance factors can be assigned to these two parameters at step S54 for integration of them. m is the importance for v1, n is the importance for v2. The average value of these two parameters is then.

$$J = \frac{(v1*m + v2*n)}{(m+n)} \tag{9}$$

At step S55 it is judged if this parameter J is higher than a predetermined threshold Th(J), namely Th(J)≧J. In the case Th(J)≧J, the vehicle considers itself in the traffic condition and a voting flag J is set to 1 at step S56. In the case Th(J)≧J the process sets the flag J to 0 at step 57. If the flag J is set to 1, a jam voting message 60 is generated at the host vehicle 1 and at step S57 transmitted via the communication means to the others vehicles 2, 3, 4 within the communication range. After the value of J is determined, the timer is set up at step S59, the in-vehicle calculation process returns to the start point when this timer is up.

FIG. 6 describes the minimum message set of the jam voting message 60 generated by a vehicle 1, 2, 3, 4. The jam voting message 60 comprises at least one of request ID, vehicle ID, message type, time stamp, position, jam voting flag, time to expire value and a direction. A request ID is used to identify one round request-answer conversation between the host vehicle and any other vehicle. This request ID can be a unique number, or a time stamp when the request has been initiated, if it is so, request ID is equal to the time stamp of the request message. The message type defines if the jam voting message 60 is a request message (p=1) or a reply message (p=0). A reply message is transmitted at certain time T1 later after the other vehicle 2, 3, 4 has received a request message from the host vehicle 1. The time stamp is the time stamp in the reply message when the in-vehicle jam estimation process is carried out, the position represents position determined by the position determining means at the time stamp, the jam voting flag is the result of voting jam value J of the reply vehicle at the time stamp, it can be set to 1 (jam) or 0 (no jam), the time to expire indicates when the data set has expired and can be discarded from the data table 60, and the direction indicates the direction of the vehicle compared to true north at the time stamp.

A timer T1 is used to define the waiting time for sending out the reply message after having received the jam request message from the host vehicle 1. When the timer T1 is up, the system will find the latest periodical jam estimation result as determined in the FIG. 5. The reply message 60 can be generated based on the jam estimation result at this latest time stamp.

In the case the message type indicates a request message (p=1). The objectives of this message are at least to announce the traffic condition the host vehicle 1 to the other vehicles 2, 3, 4 within the communication range.

Every other vehicle 2, 3, 4 receiving a request message generates a reply message after waiting for a certain time T1, wherein the message type flag p is set to 0.

Accordingly, the jam voting flag J is the result of the calculation of other vehicles 2, 3, 4 within the communication range. If it is in jam, the flag J in the reply message is set to 1; if not, it will be set to 0.

The message type flag p is to distinguish if the message is a request message or a reply message from other vehicles. If it is a request message originated from a jammed vehicle, the message type is 1. If it is a reply message from the other vehicle 2, 3 which has received the request, the message type will be set to 0.

Figure 7:
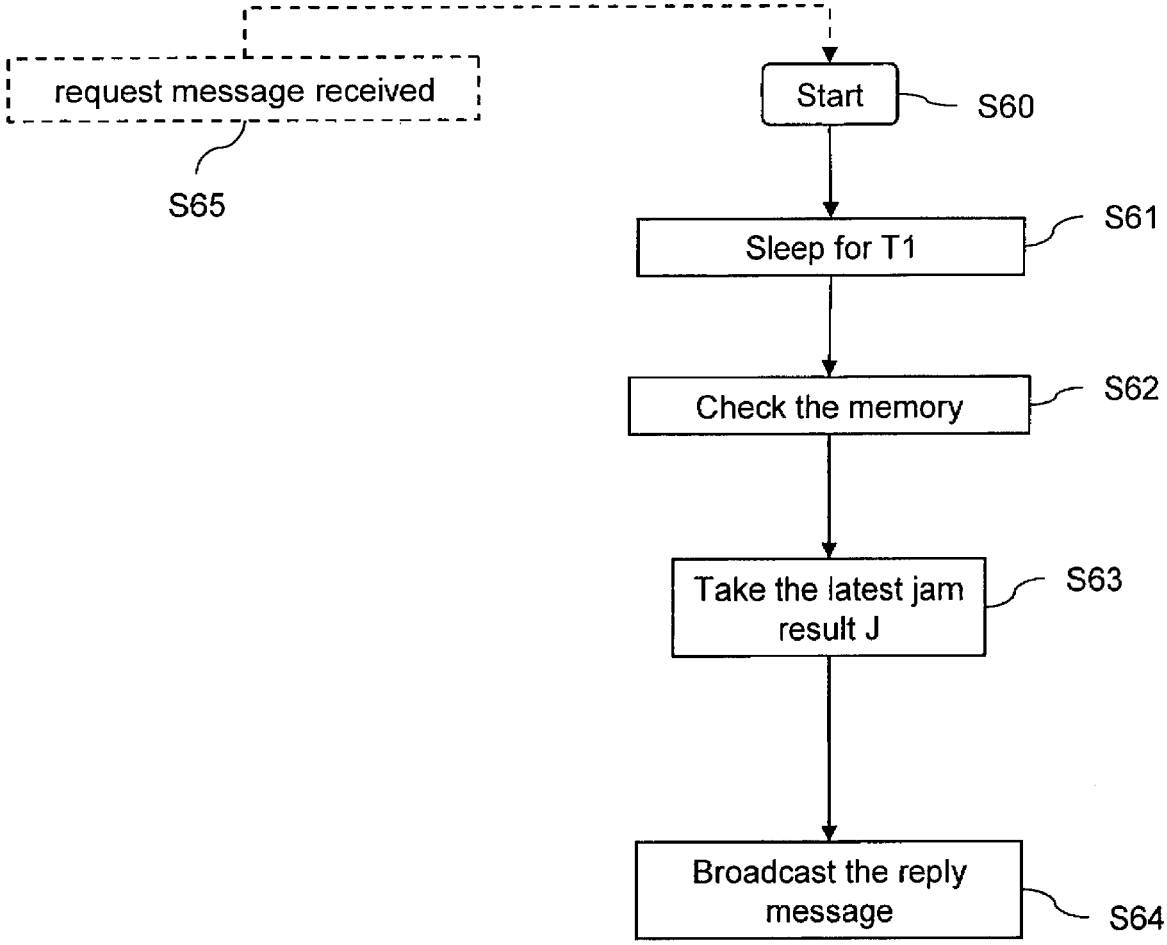
FIG. 7 shows a flowchart of an in-vehicle calculation and reply process at another vehicle

FIG. 7 shows the flow chart of the reply process at the other vehicle 2, 3, 4 once the vehicle has received a broadcasted request voting message from the host vehicle 1. The process starts at the step S60 after the other vehicle 2, 3, 4 has received a request voting message at step S65. The system will turn to sleep and wait the timer T1 is up at step S61. At step S62, the system checks the periodical jam estimation results J as described with reference to FIG. 5 in the memory. The time stamp which is closest to the time that the timer is up is be found out at this step S62. Next, at the step S63, the latest results of the jam estimation of this latest time stamp is used to generate the jam reply message 60, wherein the jam estimation results include at least the latest time stamp, J value at this time stamp, and the position data of the vehicle at this time stamp. At last step S64, the reply message is broadcasted to the vehicle-to-vehicle communication network.

Figure 8:
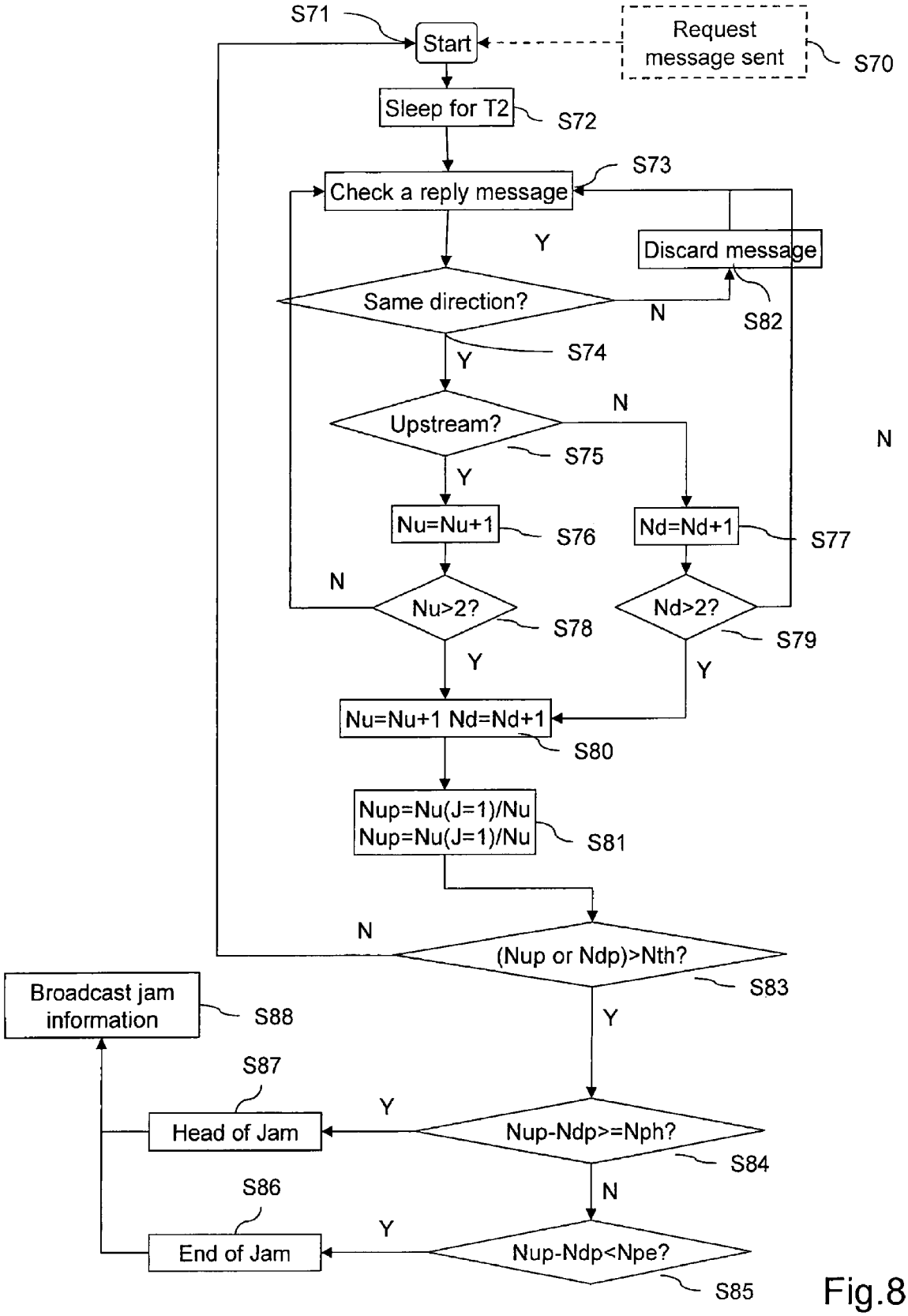
FIG. 8 shows a flowchart of a jam voting process.

FIG. 8 shows the flow chart of the voting process in the host vehicle 1 based on the received replies from the other vehicles 2, 3, 4. The process begins at step S71 when the host vehicle 1 sends out a request message to other vehicle 2, 3, 4 (S70). The system is then turn to sleep and wait a certain time T2 at the step S72 in order to collect the reply messages. Another timer T2 is set up by the system for this waiting period. T2 should be larger than the timer T1 in order to leave the other vehicles to transmit the reply message.

When the timer T2 is up, the system will begin to check the reply messages by one by at the step 73. For each reply message, it is judged, at the step 74, if the vehicle issuing the reply message does travel in the same driving direction as the host vehicle 1. If the other vehicle does travel in the same direction, the process is continued at step S75, otherwise, the reply message is discarded at step S82 and the process returns to the step S73 and starts to check the next reply message. At step S75 it is judged if the other vehicle is driving upstream of the host vehicle 1 by calculating the angle δ compared to the host vehicle 1. Accordingly, this calculation divides the vehicles into two groups: a group of upstream vehicles and a group of downstream vehicles. Voting message counters are set at the host vehicle 1 at steps S76 and S77 to count the number of reply messages. The number of the messages from upstream traffic is denoted as $N_u$, from the downstream traffic is denoted as $N_d$. Additionally, the counting can also separated by the value of the jam voting flag J. Accordingly, there may be at lest 2 counters needed.

$$[N_u^{J=1}, N_u^{J=0}, N_d^{J=1}, N_d^{J=0}]$$

If the host vehicle counts more than 2 replies from upstream traffic at step S78 or downstream traffic at step S79, the counting process is continued at the step S80, otherwise, the process returns to the step S73 and continues to check other received reply messages during the timer T2. For each direction, we calculate the percentage of the messages with jam (J=1) at step S81. $N_{up}$ denoted the percentage of jam (J=1) replies in an upstream direction, $N_{dp}$ denotes the percentage of jam (J=1) replies in a downstream direction. Therefore, if $N_u^{J=1}+N_u^{J=0} \geqq 2$ then $$N_{up} = \frac{N_u^{J=1}}{(N_u^{J=1} + N_u^{J=0})}$$

and if $N_d^{J=1}, N_d^{J=0} \geqq 2$ then $$N_{dp} = \frac{N_d^{J=1}}{(N_d^{J=1} + N_d^{J=0})}$$

(see steps S78-S81)

If any of the two percentages is more than the threshold Th(Nth), the host vehicle 1 is in the traffic condition (step S83), otherwise, the process will return to the start until the next jam request message is broadcasted.

If the difference of the percentage $N_{up}$ and the percentage $N_{dp}$ is larger than a predetermined threshold value $N_{ph}$ (step S84), the host vehicle 1 is at or near the head of the traffic condition (step S87). If the difference of the percentage $N_{up}$ and the percentage $N_{dp}$ is less than a predetermined threshold value $N_{pe}$ (step S85), the host vehicle 1 is at or near the end of the traffic condition (step S86). These thresholds $N_{ph}$ and $N_{pe}$ can be calibrated prior the use or adapted during a learning phase.

If $N_{up} \geqq Th(Nth)$ or $N_{dp} \geqq Th(Nth)$, the host vehicle is in jam if $N_{up}-N_{dp} \geqq N_{ph}$, the host vehicle is in the head of jam If $N_{up}-N_{dp} \leqq N_{pe}$, the host vehicle is in the end of jam After the position of the host vehicle 1 with respect to the traffic condition has been determined, said traffic jam information is transmitted as a traffic condition information message and/or a jam information message at step S88.

Figure 9:
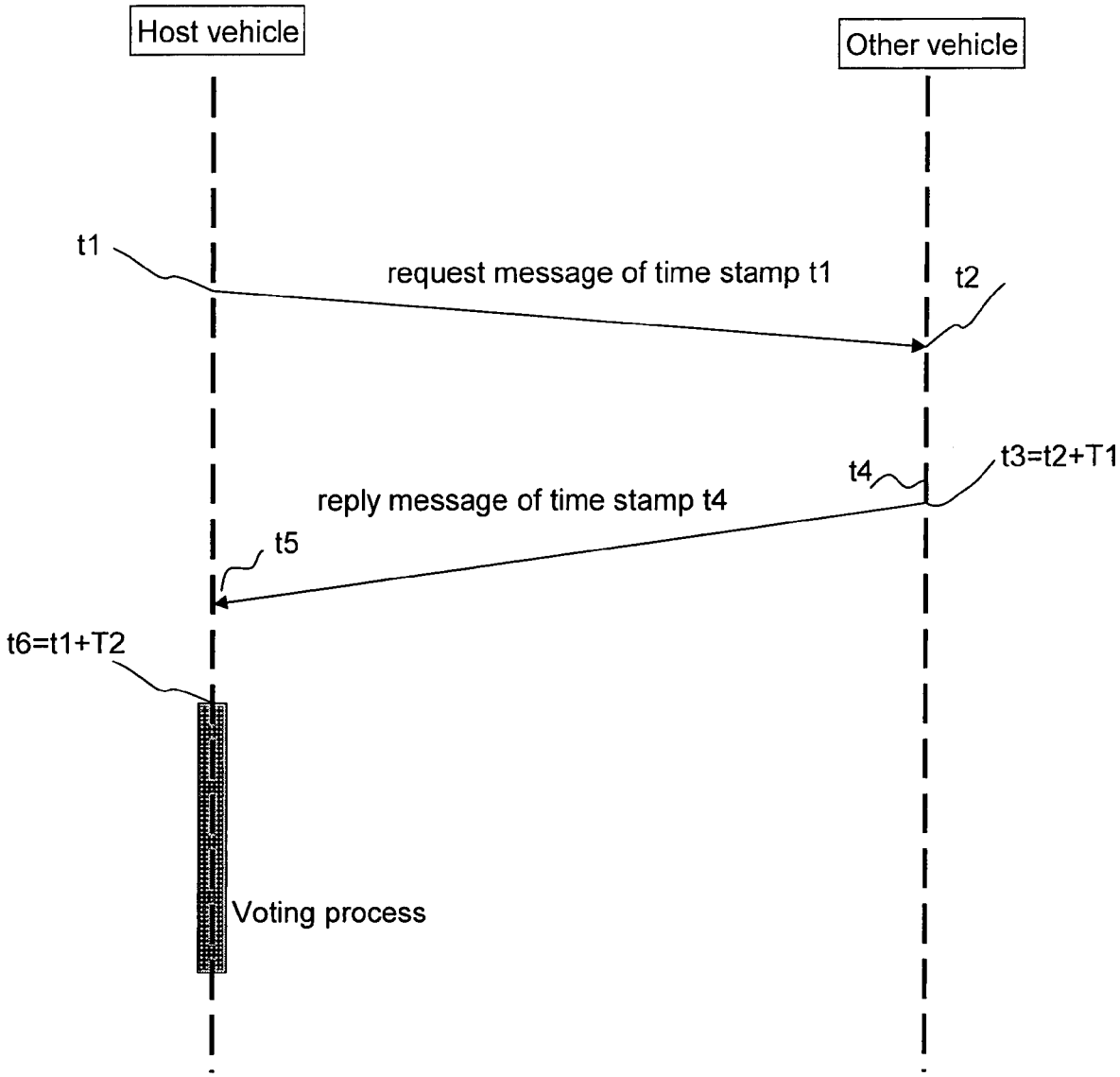
FIG. 9 shows a communication sequence diagram between the host vehicle and at least one other vehicle

FIG. 9 shows a communication sequence diagram for the voting process for any pair of the vehicles. On the left is the time sequence of the host vehicle, on the right side is the time sequence of the other vehicle. In both vehicles, the periodical jam estimation process as described in the FIG. 5 is carried out separately. Consequently, multiple jam estimation results are obtained for different time stamp, wherein the jam estimation results include the time stamp, the jam estimation value J, and the position data of the vehicle at this time stamp. At time t1, the host vehicle detects a jam (J=1) and broadcast a jam voting request message into the vehicle-to-vehicle communication network. This jam request message is received by the other vehicle at time t2, the timer T1 is set up at t2. When the timer T1 is up at t3=t2+T1, the other vehicle will check the latest jam estimation time stamp, which is t4. The jam estimation result of the time stamp t4 will be set as a reply message 60 and sent back to the host vehicle. t5 is the time when the reply message is received by the host vehicle.

On the host vehicle side, when the request message is sent out at t1, it will at the same time set up a timer T2 (T2>T1) to wait for the replies from other vehicles in the network. The timer T2 is up at the moment t6, t6=t1+T2. From the time t6, the voting process will start as described in FIG. 8 at the step S73.

Figure 10:
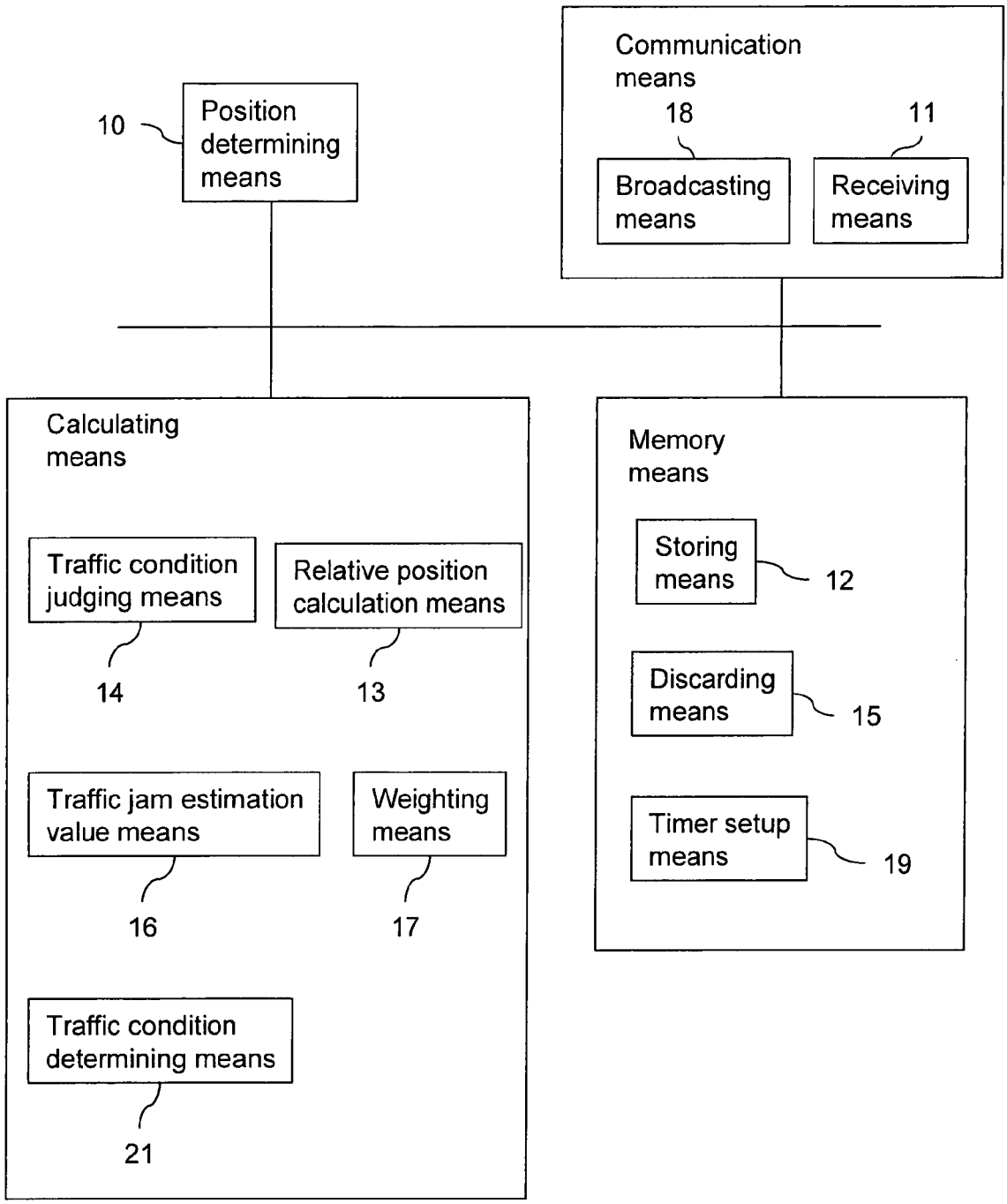
FIG. 10 shows schematically an apparatus for road congestion detection.

FIG. 10 shows schematically the apparatus for a road congestion detection. The apparatus may comprise a position determining means 10, a calculation means, a communication means and a memory means. The calculation means may further comprises one of traffic condition judging means 14, relative velocity calculation means 13, traffic jam estimation value means 16, weighting means 17 and traffic condition determining means 21. The communication means may further comprise a broadcasting means 18 and receiving means 26. The memory means may further comprise storing means 12, discarding means 15 and timer setup means 19. All means are connected by a bus. The above described apparatus can be realized in software, in hardware or in a combination thereof.

Features, components and specific details of the structures of the above-described embodiments may be exchanged or combined to form further embodiments optimized for the respective application. As far as those modifications are readily apparent for an expert skilled in the art they shall be disclosed implicitly by the above description without specifying explicitly every possible combination, for the sake of conciseness of the present description.

We claim:

1. A method, using programmable hardware and software for programming the hardware, for determining traffic condition comprising the steps of:

determining periodically a position data of a host vehicle, wherein the position data includes a time stamp, position, velocity and driving direction of the host vehicle, receiving periodically position data of at least an other vehicle, wherein the position data includes a time stamp, position, velocity and driving direction of the other vehicle, storing the position data of the host vehicle and the position data of at least the other vehicle, calculating a relative position data, wherein the relative position data includes relative velocity and relative driving direction between the host vehicle and the other vehicle, and judging a traffic condition based on the position data of the host vehicle, the position data of the other vehicle and the relative position data, wherein:

based on the position data of the host vehicle a traffic jam estimation value is determined;

based on the relative position data between the host vehicle and the other vehicle a relative traffic jam estimation value is determined;

based on the traffic jam estimation value and the relative traffic jam estimation value a voting jam value is determined; and the software programs the hardware to perform the steps of the method.

2. The method according to claim 1, wherein the position data of the other vehicle is discarded when the angle of the relative direction between the host vehicle and the other vehicle is larger than a predetermined angle.

3. The method according to claim 1, wherein the position data of the other vehicle is discarded when the time interval between the timestamp of the other vehicle and the actual time is larger than a predetermined period.

4. The method according to claim 1, wherein based on the relative position data, the traffic jam estimation value and the relative traffic jam estimation value are weighted.

5. The method according to claim 1, wherein based on the voting jam value a voting request message is broadcasted by the host vehicle.

6. The method according to claim 5, wherein the other vehicle broadcasts a voting reply message as response to the voting request message of the host vehicle.

7. The method according claim 6, wherein based on the voting request message and the voting reply messages received by the host vehicle the traffic condition is determined.

8. The method according to claim 6, wherein based on the voting request message and the voting reply messages the position of the host vehicle in respect to the traffic condition is determined.

9. The method according to claim 1, wherein based on the position of the host vehicle in respect to the traffic condition a corresponding traffic condition message is broadcasted.

10. An apparatus for determining traffic condition comprising:

a position determining system which periodically determines a position data of a host vehicle, wherein the position data includes a time stamp, position, velocity and driving direction of the host vehicle;

a receiver which periodically receives position data of at least an other vehicle, wherein the position data includes a time stamp, position, velocity and driving direction of the other vehicle;

a memory which stores the position data of the host vehicle and the position data of at least the other vehicle; and programmable hardware and software for programming the hardware, wherein execution of the software causes the hardware to perform a method comprising:

calculating a relative position data, wherein the relative position data includes relative velocity and relative driving direction between the host vehicle and the other vehicle;

judging the traffic condition based on the position data of the host vehicle, the position data of the other vehicle and the relative position data;

determining a traffic jam estimation value based on the position data of the host vehicle;

determining a relative traffic jam estimation value based on the relative position data between the host vehicle and the other vehicle; and determining a voting jam value based on the traffic jam estimation value and the relative traffic jam estimation value.

11. The apparatus according to claim 10, wherein the software further causes the hardware to perform discarding the position data of the other vehicle when the angle of the relative direction between the host vehicle and the other vehicle is larger than a predetermined angle.

12. The apparatus according to claim 10, wherein the software further causes the hardware to perform discarding the position data of the other vehicle when time interval between the timestamp of the other vehicle and the actual time is larger than a predetermined period.

13. The apparatus according to claim 10, wherein the software further causes the hardware to perform determining a weighting factor based on the relative position data, the traffic jam estimation value and the relative traffic jam estimation value.

14. The apparatus according to claim 10, further comprising a transmitter which broadcasts a voting request message of the host vehicle based on the voting jam value or a voting reply message of the other vehicle.

15. The apparatus according to claim 14, wherein the receiver receives a voting reply message from the other vehicle or a voting request message from the host vehicle.

16. The apparatus according to claim 14, further comprising a timer to generate the voting reply message at the other vehicle side or to collect the voting reply messages at the host vehicle side.

17. The apparatus according to claim 14, wherein the software further causes the hardware to perform determining a traffic condition based on the voting request message and at least one received voting reply message.

18. The apparatus according to claim 14, wherein the position determining system determines the position of the host vehicle in respect to the traffic condition based on the voting request message and the voting reply message.

19. The apparatus according to claim 14, wherein the transmitter broadcasts a corresponding traffic condition message based on the position of the host vehicle in respect to the traffic condition.

* * * * *